United States Patent [19]

Roos et al.

[11] 4,204,337

[45] May 27, 1980

[54] METHOD AND APPARATUS FOR MONITORING AND CONTROLLING THE DRYING PROFILE IN A CONTINUOUS-OPERATION MULTI-ZONE DRIER

[75] Inventors: Friedrich Roos, Hauneck; Friedrich Bahner, Rotenburg, both of Fed. Rep. of Germany

[73] Assignee: Babcock-BSH Aktiengesellschaft vormals Büttner-Schilde-Haas AG, Krefeld, Fed. Rep. of Germany

[21] Appl. No.: 906,847

[22] Filed: May 15, 1978

[30] Foreign Application Priority Data

May 14, 1977 [DE] Fed. Rep. of Germany ..... 2721965

[51] Int. Cl.[2] ..... F26B 3/04

[52] U.S. Cl. ..... 34/31; 34/48; 34/52; 34/44

[58] Field of Search ..... 34/23, 25, 31, 28, 44, 34/52, 48, 216, 212, 213

[56] References Cited

U.S. PATENT DOCUMENTS

| | | | |
|---|---|---|---|
| 2,442,148 | 5/1948 | Rose | 34/52 |
| 2,758,386 | 8/1956 | Cobb | 34/31 |
| 2,799,096 | 7/1957 | Scott | 34/31 |
| 3,078,587 | 2/1963 | Huck | 34/52 |
| 3,259,995 | 7/1966 | Powischill | 34/52 |
| 3,961,425 | 6/1976 | Swanson et al. | 34/52 |

*Primary Examiner*—Larry I. Schwartz
*Attorney, Agent, or Firm*—Michael J. Striker

[57] ABSTRACT

Plyboard or the like passes through the successive drying zones of a multi-zone drier, has a varying initial moisture content and presents to the drier a fluctuating degree of loading (surface area). The drying action is varied by adjusting the drying-gas temperature and/or the transport speed of the goods through the drier, so as to quickly match the drying action to the fluctuating drying demand. Instead of measuring initial moisture content per se and degree of loading (surface area) per se, temperature measurements are performed, from which equivalent information is derived, and from which in turn are calculated the values of drying-gas temperature and/or transport speed which must be set on the temperature and speed controllers of the drier.

11 Claims, 6 Drawing Figures

METHOD AND APPARATUS FOR MONITORING AND CONTROLLING THE DRYING PROFILE IN A CONTINUOUS-OPERATION MULTI-ZONE DRIER

BACKGROUND OF THE INVENTION

The present invention relates to the drying of plyboard and the like in continuous-operation drying installations wherein the plyboard to be dried continuously travels through a long drier consisting of a succession of drying zones. In each drying zone, air is circulated in the direction transverse to the transport direction of the goods through the drier, the air in each drying zone being driven by fans to sweep over a heating battery and circulating about the goods passing through the respective zone, the air being blown onto the goods to be dried in that zone through nozzles. In particular, the present invention relates to monitoring and controlling the operation of such conventional drying installations. The monitoring and controlling of such installations can become very problematic when, as is typical, both the degree of loading of the drier and also the initial moisture content of the goods to be dried fluctuate markedly. The degree of loading of the drier is typically expressed by the amount of surface area of the goods to be dried per unit length.

For example, when passing plyboard through such a conventional drier, the degree of loading (amount of surface area at which drying is to be effected) and the initial moisture content of the plyboard can vary very considerably. If the product emerging at the output end of the succession of drying zones is to nevertheless be of uniform residual moisture content and general quality, then it is necessary that the operator, in quick response to such fluctuations in the degree of loading and initial moisture content, adjust the transport speed at which the goods are being transported through the drier and/or adjust the drying parameters, e.g., temperature of the hot air used for drying, moisture content of the hot air employed, etc.

Very often, for the sake of simplicity, the average temperature conditions of the hot drying air in the succession of drying zones is kept more or less constant, and then to vary the drying effectiveness in response to fluctuating drying demand, the operator simply increases and decreases the transport speed using a control lever, or the like, to thereby vary the amount of time the goods to be dried dwell in the successive zones of the drier. In order to proceed on this basis, frequent evaluation of the residual moisture content of the emerging dried goods is necessary. Accordingly, the operator's attempt to match the drying action afforded to the drying demand is very approximate and coarse. Furthermore, attempting to match the prevailing drying action to the prevailing drying demand in this simple way, i.e., by control of dwell time only, can be problematic in highly automated installations; for example, if the long drier is connected to a long production line, and the goods are fed to the drier automatically and automatically removed from the drier, adjustment of dwell time in this way can conflict with the speeds of operation and productivity of processing units located upstream and downstream of the drier.

It is known to positively measure the initial moisture content and degree of loading (surface area) of the goods to be dried before they actually enter the drier, and to adjust the average drying temperatures of the hot air in the successive drying zones accordingly, in an attempt to match drying action to drying demand. However, positively measuring these two quantities can be very troublesome and problematic, for example requiring the use of a kiln-drying test, and despite the troublesomeness is not always sufficiently reliable.

To improve the quality of the dried product emerging from the drier, it is known not to adjust the temperature of the hot drying air incident upon the dried goods, but instead to attempt to meet drying demand by measurement and negative-feedback control of the temperature of the hot drying air which has already contacted and is leaving the dried goods. This decreases the problematic tendency towards insufficient drying action typically encountered when the degree of loading (i.e., surface area to be dried) is high. It is also known to try to improve quality by using negative-feedback control to maintain constant the moisture content of the recirculated hot drying air at the point where the hot drying air has already contacted and is leaving the goods.

These various techniques all have characteristic shortcomings.

SUMMARY OF THE INVENTION

It is a general object of the invention to provide a system for monitoring and controlling the operation of multi-zone driers of the type in question, the system responding to fluctuations in the degree of loading and initial moisture content in a sensitive way to automatically adjust the drying action in a manner which really comes close to being exactly optimal, i.e., which really corresponds to variations in the drying demand.

Instead of attempting to measure initial moisture content and degree of loading (surface area of drying) directly, the present invention derives this information, or equivalent information, from simpler and easier to perform measurements, and then uses this information to automatically vary the drying action in response to the fluctuating drying demand. In each of a plurality of the succession of drying zones, the present invention ascertains, from relatively simple and easy to perform measurements, the rate at which heat is being consumed in the drying process and the moisture content of the hot drying air. From this information, by reference to elementary thermodynamic relationships of heat-exchange pertaining to drying action, and also considering the differences in drying action occurring as between more upstream and more downstream drying zones, it is possible to readily calculate the drying temperatures and/or dwell times (equivalently transport speeds) needed to match the prevailing drying action to the prevailing drying demand, and the calculated values of requisite temperature and/or transport speed are then applied to negative-feedback systems operative for then maintaining such temperatures and/or transport speed at the values ascertained to be necessary.

Advantageously, the heat-consumption and air-moisture measurements are performed in at least two of the succession of drying zones, e.g., the first and the last. Likewise, if drying temperature is the quantity to be adjusted (as opposed to transport speed), at least two separate negative-feedback temperature control systems are to be used.

If the automatic matching of drying action to drying demand is to be performed by adjustment of drying temperature, not transport speed, then if the rate at which heat is being consumed due to drying reaches certain limit values, an automatic negative-feedback control system for transport speed can be automatically activated, or else an optical or acoustic signal can be generated, to alert the operator to the situation so that he can manually adjust transport speed in such an event. Preferably the monitoring of whether the rate of heat consumption reaches such limit values is performed at one of the most downstream zones of the drier.

The generation of information concerning the amount of heat consumed in individual drying zones due to the drying action can advantageously be derived from mainly two simple temperature measurements in that zone, and to this end such zone can be provided with two thermometers located upstream and downstream of the heating battery for the recirculated air in that zone (i.e., to measure heating-air temperature at the points upstream and downstream of the zone where the air is reheated), or else upstream and downstream of the air's zone of contact with the goods. Thus, one can measure, in the latter case, the temperature drop resulting from the drying-action heat exchange with the goods or else, in the former case, the temperature rise resulting from reheating of the recirculated air in preparation for its next contact with the goods.

However, persons familiar with thermodynamic principles will understand that deriving heat-consumption-rate information using thermometers arranged just upstream and downstream of the heating battery (i.e., just upstream and downstream of the zone where the circulated air is reheated) is only advantageous when the state of the drying heat-exchange is close to true thermodynamic equilibrium. In contrast, if one measures the drying-air temperature at the points where the circulated air begins to contact and dry the goods and then leaves the goods, the thusly measured temperature drop can be approximately, but rather accurately, correlated with the rate of heat consumption, if the volumetric flow rate of the recirculated heating air (expressed in units of volume per unit of time) is constant, which is readily and indeed typically made the case by reason of the fans employed, and provided that the operating parameters employed (air temperature and moisture content) are kept in ranges such that the heat transfer, although it varies numerically, does not change with respect to its overall character. Furthermore, for the temperature ranges conventionally employed, the density and specific heat capacity of the recirculated hot drying air vary within only very small limits; however, even these variations can be readily taken into account, if desired, when one begins to operate on a calculated-value basis in accordance with the inventive technique.

As already indicated, it is not merely preferred that the requisite measurements be performed at two different zones (e.g., the most upstream and the most downstream) of the drier; additionally, it is preferred that the temperature adjustments be implemented using at least two distinct negative-feedback temperature-regulation systems, each controlling drying-air temperature in a respective sector of the drier. Performing the requisite measurements at at least two different zones is tied in to the reliability and quality of the information generated; adjusting temperature separately for at least two different sectors of the drier relates to creating the maximum degree of freedom for establishing a drying-action profile which optimally exploits the information generated. In particular, this is of importance if the drying-action profile is to be quickly automatically adjusted in response to abrupt changes in the degree of loading, e.g., from 0% to a normal-operation value of about 50–70%, occurring when for example an empty transport stretch containing no goods is followed by a stretch containing e.g., a plyboard having 50–70% of the maximum width the drier can accept.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
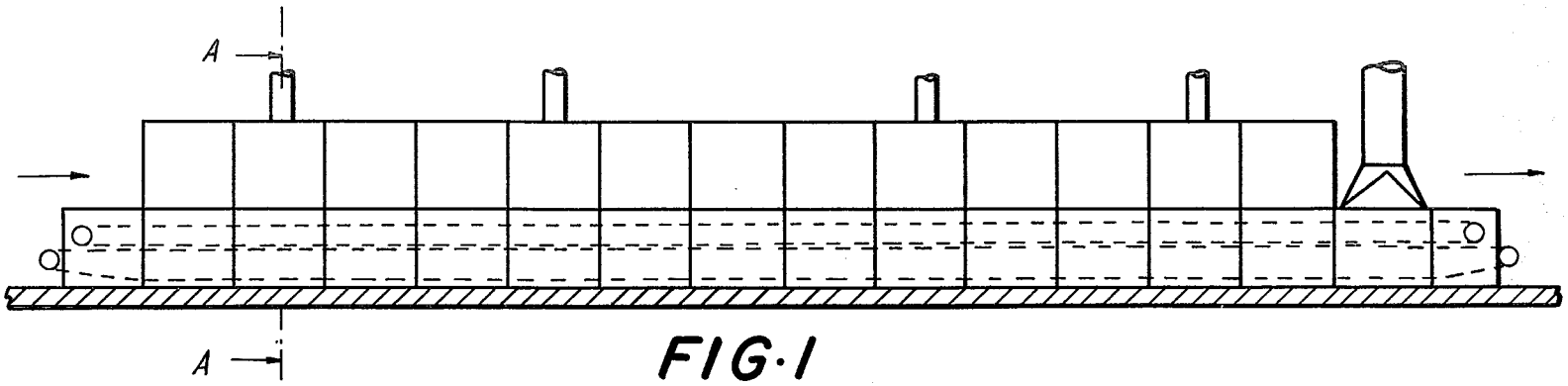
FIG. 1 is a side view looking at a conventional multi-zone drier.
Figure 2:
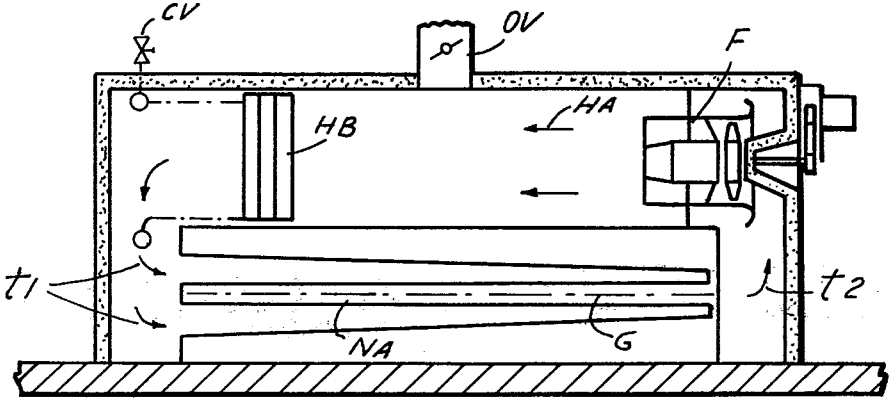
FIG. 2 is a vertical section, taken along line A—A in FIG. 1, through one drying zone of the conventional multi-zone drier.

FIGS. 1 and 2 schematically depict a multi-zone drier of convention type. Plyboard to be dried is fed into the left end in FIG. 1, transported through the successive zones of the drier, and emerges at the right end. FIG. 2 is a vertical section taken on line A—A of FIG. 1, and illustrates the familiar internal construction of one drying zone of the multi-zone drier, showing the conventional heating battery HB serving as a heat exchanger for reheating circulating hot drying air, heating battery HB being controlled by a heat-exchange fluid control valve CV or the like, the heating air (represented by arrows HA) being recirculated at constant volumetric flow rate by a fan F, the heating air being driven in at the left in FIG. 2 into a nozzle arrangement NA through the nozzles of which it is blown onto the goods G to be dried, the air after passing in contact with the goods G emerging at the right end of the nozzle arrangement NA and being returned by fan F to the heating battery HB for reheating. The heating air has a temperature $t_1$ at a point upstream of where it contacts the goods G, and a temperature $t_2$ at the point downstream of where it contacts the goods G. An outlet valve OV schematically represents the usual means for adding and removing air from the recirculated-air heating zone, e.g., when the moisture content of the air has become too high, in general to adjust the moisture content of the air, or when the moisture content of the air is actually to be adjusted to a preselected value by conventional negative-feedback control techniques.

Figure 3:
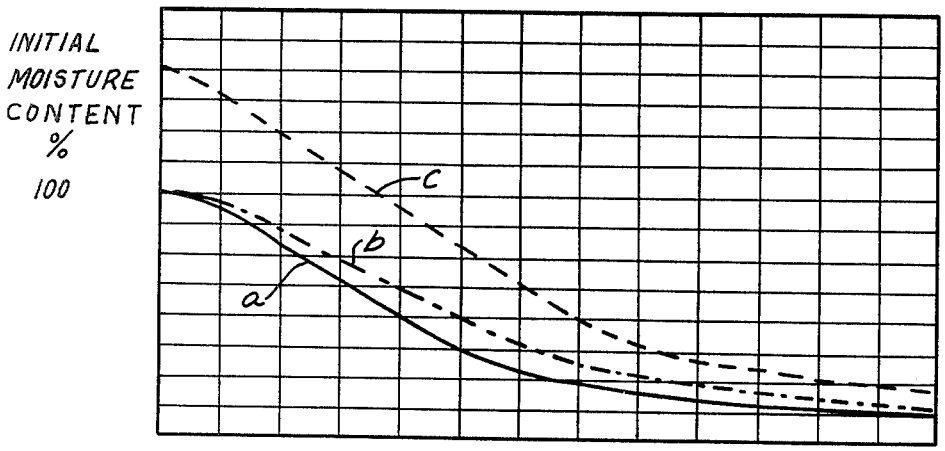
FIG. 3 is a graph showing, for plyboard having three different combinations of initial moisture content and degree of loading, the moisture content which the plyboard has during its travel through the successive drying zones of the multi-zone drier of FIGS. 1 and 2.

FIG. 3 depicts the moisture content of plyboard having three different combinations of initial moisture content and surface area, as such plyboard passes through the successive zones of the multi-zone drier. Curve a (solid line) represents plyboard having an initial moisture content of 80% and presenting to the drier a degree of loading equal to 70%; e.g., this may be simple constant-width plyboard whose width is equal to 70% the maximum width which can pass through the drier; with the drying-air temperatures of the zones properly set (e.g., in accordance with conventional technique), the dried plyboard emerging from the drier has a residual moisture content of about 10%. Curve b (dash-dot line) represents plyboard again having an initial moisture content of 80%, but not presenting to the drier a degree of loading equal to 100% (full loading of the drier). Curve c (broken line) represents plyboard presenting a degree of loading equal to 70% (as with curve a) but having a very high initial moisture content of 120%. The drying parameters maintained in the successive zones of the drier are the same for the three different cases.

Figure 4:
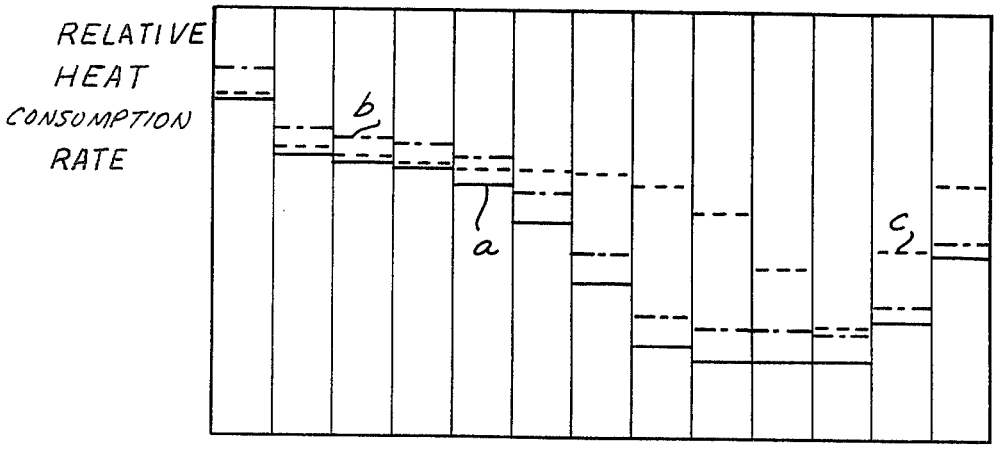
FIG. 4 is a graph showing, for the same three materials as graphed in FIG. 3, the relative heat-consumption rates prevailing in the successive zones of the multi-zone drier.
Figure 5:
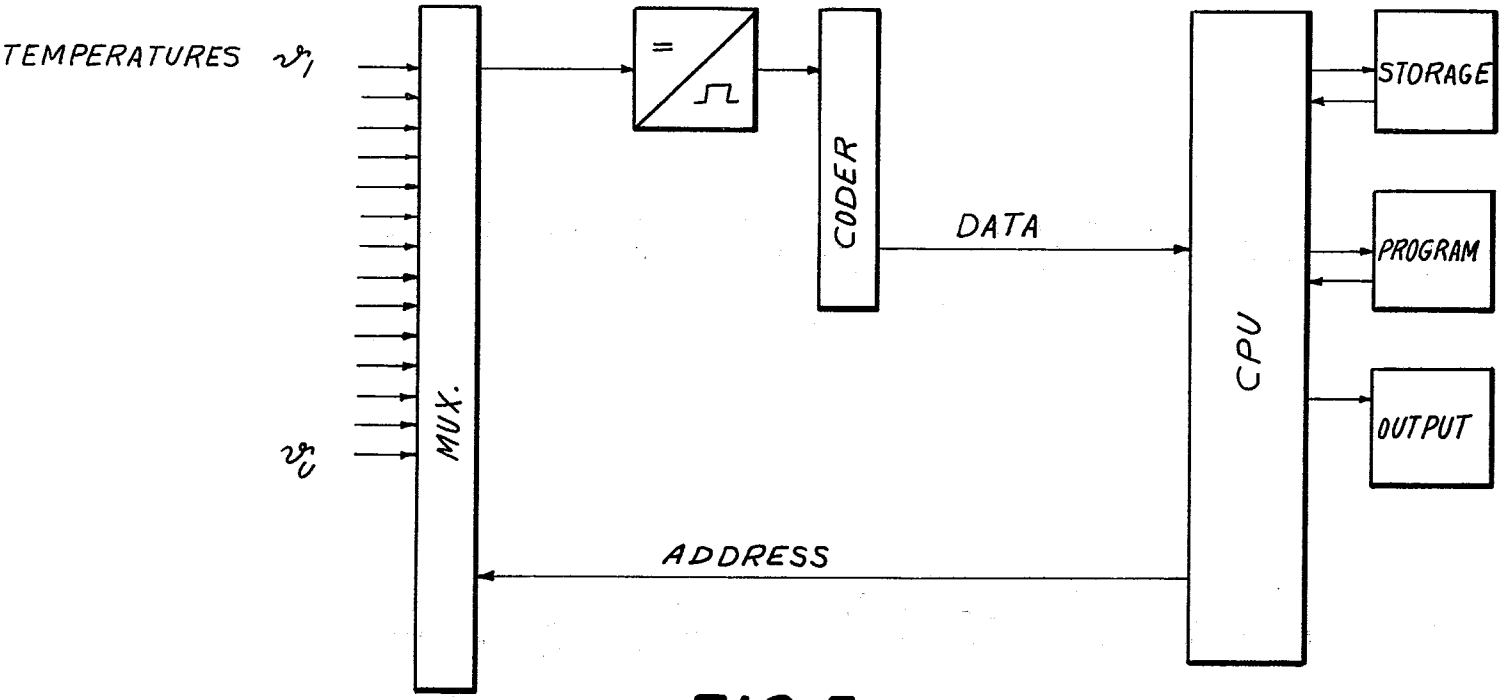
FIG. 5 is a block schematic diagram of a computer set-up for processing the measured drying-air temperature values.

FIG. 4 is a graph corresponding to FIG. 3, but showing the rate at which heat is being lost by drying air in the successive drying zones of the multi-zone drier, again for loading of 70% and initial moisture content of 80% (a); for loading of 100% and initial moisture content of 80% (b); and for loading of 70% and initial moisture content of 120%; and again with the heating parameters in the drier set the same for all three cases. The following facts can be seen in FIG. 4. In the most upstream drying zones, the drying of plyboard having a high initial moisture content of 120% (c) involves a higher heat-consumption rate than for board having an initial moisture content of only 80%, both boards having the same surface area (70% loading). However, first, the difference in the heat-consumption rates in these first drying zones is not very great; secondly, although there is a difference in the heat-consumption rates in these first zones, the heat-consumption rate decreases going from one zone to the next in approximately the same manner for both boards. This situation is attributable to the fact that, in the first zones of the drier, both the very moist and the only moderately moist board present the drying air with not greatly different heating-demand situations.

In contrast, in the middle zones of the drier, the heat-consumption rate for the initially very moist board (c) and the moderately moist board (a) begin to deviate markedly. Clearly, the moderately moist board (a) has now undergone a considerable decrease in moisture content, and is presenting less and less of a heating or drying demand to the hot drying air; in contrast, the initially very moist board (c) still has a fairly high moisture content, and thus continues for a longer time to present a high drying demand comparable to that prevailing in the first zones of the drier. It is to be noted that the two boards in question (a) and (c) both present the same degree of loading in terms of surface area (70%). Clearly, their difference with respect to initial moisture content can be seen in the differing heat-consumption rates prevailing in the first zones, and also in the number of the drying zone at which the heat-consumption rates begin to change dissimilarly and in the extent of the dissimilar changes. The differences in heat-consumption rate for the middle drying zones constitutes, of course, not merely data reflecting upon the initial moisture-content values, but upon the present moisture-content values for the sections of board in the middle drying zones per se.

In the final zones of the drier, and as shown in FIG. 4, the heat-consumption rate goes up. Persons familiar with such driers will understand that this is because, in the terminal drying zones, drying air of considerably lowered moisture content is utilized, to effect the final phases of the drying upon the already quite dry plyboard. Of course, when drying in the terminal stages using lowered-moisture drying air, this inherently boosts the heat-consumption rate.

A comparison of curves a and b indicates how, in accordance with the present invention, information can be generated dependent upon the degree of loading presented to the drier. In both curves a and b, the initial moisture content is 80%, whereas the degree of loading is 70% for curve a and 100% for curve b. With the initial moisture content unchanged, if the degree of loading jumps from 70% to 100%, then as can be seen in FIG. 4, the heat-consumption rate increases by an amount which is approximately equal for all the zones in the multi-zone drier. By measuring the difference between the temperature at $t_1$ (FIG. 2) of the drying air about to contact the goods during a working pass and the temperature at $t_2$ (FIG. 2) of the drying air leaving the goods upon completion of a working pass and about to be returned to the heating battery HB, the temperature drop thusly measured is already to a first approximation proportional to the degree of loading presented by the goods to the drier. Other measuring techniques, such as measuring the air temperatures just upstream and downstream of the heating battery HB, would also contain such information, but to a greater extent complicated by other energy transformations.

In terms of practical significance, if the degree of loading presented to the drier increases in this way then, if the moisture content of the air just downstream of the goods is not maintained constant by negative-feedback action, the moisture content of the drying air will increase and the effective value of the drying-air temperature decrease. The effective temperature of the air is approximately equal to the average of the temperatures at $t_1$, $t_2$ of the air just upstream and downstream of the goods. In either event, the result is a decrease in drying action, resulting in a too high moisture content in the goods emerging from the drier.

As already indicated, the increase in the degree of loading (due to the increased surface area of the goods) can be calculated from the increase in the heat-consumption rate. For this purpose, it is best to use the measurements performed at the most upstream one or ones of the drying zones because, as already explained, at these zones the heat-consumption rate is to the greatest degree independent of initial moisture content and therefore to the greatest degree dependent only on the degree of loading. When the degree of loading F has been ascertained, one can then determine the value of temperature at point $t_1$ necessary for the loading-degree increase, in accordance with the following equations:

$$G=\alpha F/r\cdot(\theta tr-\theta f) \quad [1]$$

$$Q=Vp\cdot c_p\cdot(\theta zu-\theta ab) \quad [2]$$

$$\theta tr=(\theta zu+\theta ab)/2 \quad [3]$$

$$\theta f=\text{const.} \quad [4]$$

wherein $c_p$=the specific heat capacity of the drying air (or other drying medium);

G=the heat-consumption rate;

F=the degree of loading (corresponding to the surface area of the goods);

r=the heat of vaporization of the moisture to be dried away;

V=the volumetric flow rate of the drying medium;

$\rho$=the density of the drying medium;

$\alpha$=the heat transfer coefficient;

$\theta$zu=the temperature of the drying medium just upstream of the goods (at point $t_1$);

$\theta$ab=the temperature of the drying medium just downstream of the goods (at point $t_2$);

$\theta$tr=the effective value of the drying-air temperature;

$\theta$f=the temperature of the cooler material at the boundary of the heat exchange; and Q=the amount of heat transferred.

On the other hand, if the degree of loading F stays unchanged but the initial moisture content increases to e.g., 120%, the resulting change in the heat-consumption rate in the first drying zones does not greatly differ from before, as already explained. Equations [1] to [3] are determinative for the drying action and heat-consumption rate.

The change of slope of the curve is reached at a later time, i.e., in a more downstream drying zone (as indicated by curves c in FIGS. 3 and 4). The heat-consumption rate shifts to higher values at the terminal zones of the drier. Without adjustment of temperature for these zones, the goods emerging from the drier would have too high a residual moisture content. The calculation of the temperatures to which the average value of the drying medium should be set by the negative-feedback temperature controllers of the drier can be readily derived, by empirical methods, from the information discussed above.

Figure 6:
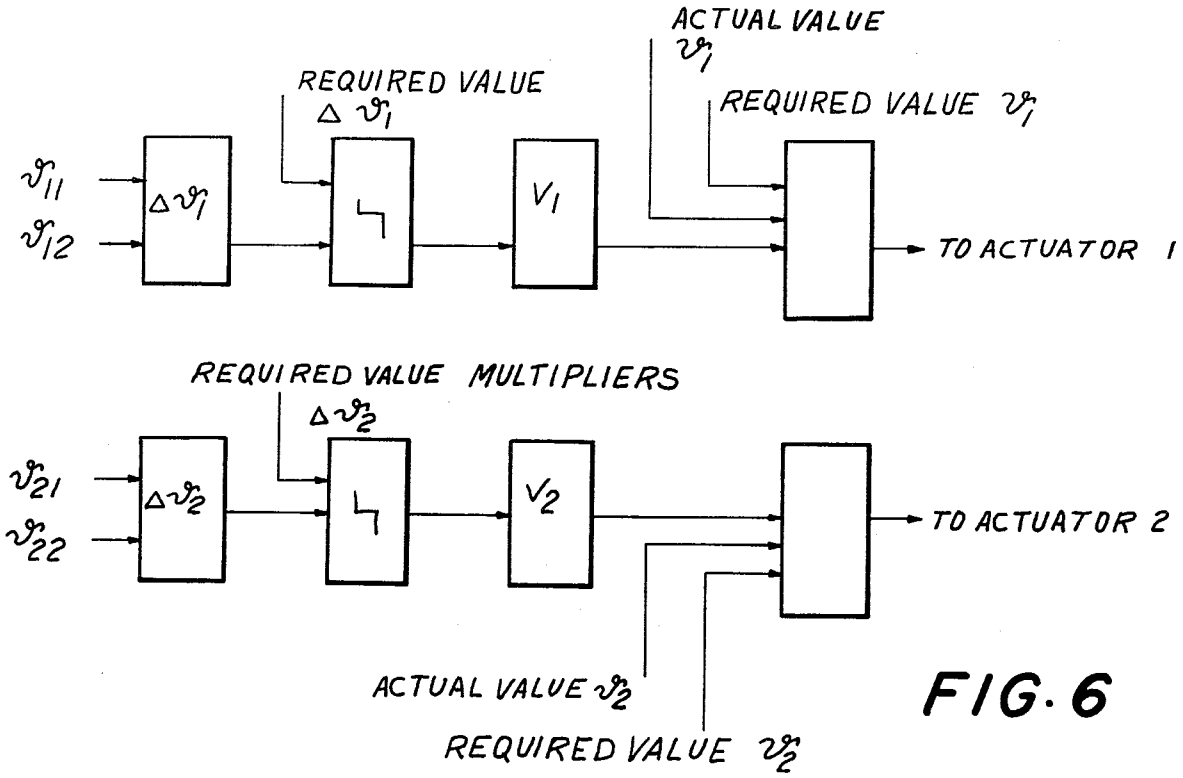
FIG. 6 is a block schematic diagram showing the adjustment of temperature in two sectors of the drier, using two negative-feedback temperature controllers.

The differing behavior of the heat-consumption rate in the initial as opposed to the terminal zones of the drier of the multi-zone drier leads to an empirical approximation which can be implemented as schematically represented in FIG. 6. When proceeding in this way, it is necessary that the moisture content of the drying air be maintained at the selected value by negative-feedback control. $\theta_{11}$ is the entrance temperature in one of the initial drying zones and $\theta_{12}$ the exit temperature in such zone. These values are processed to yield the difference $\Delta\theta_1$. Likewise, the values $\theta_{21}$ and $\theta_{22}$ pertain to one of the terminal zones.

The main advantage of the invention is that, instead of having to more or less directly measure the degree of loading and the initial moisture content of the goods, the equivalent of such information can be derived from readily and reliably performed temperature measurements, and these measurements then inputted to a computer which can, by proceeding with reference to elementary thermodynamic equations of heat exchange and evaporation, automatically determine and then set the drying-air temperature for the negative-feedback temperature controllers of the drier, to yield a product whose moisture content has the desired value despite the fluctuations in question.

FIG. 6 depicts in a very simplified way the manner in which the temperature measurements in question are processed by a central processing unit CPU to yield the requisite values, i.e., to yield the temperatures which should be set on the negative-feedback temperature controllers of the drier.

It will be understood that each of the elements described above, or two or more together, may also find a useful application in other types of constructions and techniques differing from the types described above.

While the invention has been illustrated and described as embodied in a particular type of conventional drier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspect of this invention.

What is claimed as new and desired to be protected by Letters Patent is set forth in the appended claims.

1. An improved method for monitoring and controlling the drying-action profile of a continuous-operation multi-zone drier comprised of successive drying zones through which are transported plyboards or analogous goods of varying initial moisture content and presenting to the drier a varying degree of surface-area loading, the continuous-operation multi-zone drier being of the type in which drying gas is circulated in each drying zone in the direction transverse to the transport direction of the goods, the drying action being adjustable by adjusting the value of the drying-gas temperature in the drying zones and by adjusting the transport speed of goods transported through the multi-zone drier, the rate of heat consumption in the initial zones of the drier varying mainly as a function of variations in the degree of surface-area loading presented to the drier by the goods and only secondarily as a function of variations in the initial moisture content of the goods, the rate of heat consumption in the subsequent zones of the drier varying as a function of both variations in the degree of surface-area loading presented to the drier by the goods and also as a function of variations in the initial moisture content of the goods, the improved method comprising automatically adjusting the drying action so as to maintain a predetermined moisture content of the goods emerging from the multi-zone drier despite variations in the degree of surface-area loading presented to the drier by the goods and despite variations in the initial moisture content of the goods, this comprising measuring the rate of heat consumption in at least one of the initial zones of the multi-zone drier to develop a first signal mainly dependent upon the degree of surface-area loading presented to the drier by the goods;

measuring the rate of heat consumption in at least one of the subsequent zones of the multi-zone drier to develop a second signal dependent upon both the degree of surface-area loading presented by the goods and the initial moisture content of the goods; and developing from the first and second signals in combination control signals used to adjust the drying action of the multi-zone drier.

2. The method defined in claim 1, furthermore comprising the step of measuring the moisture content of the drying gas circulated in a pluraity of the zones of the multi-zone drier to develop a gas-moisture-content signal and automatically adjusting the moisture content of the circulated drying gas in dependence thereon.

3. The method defined in claim 1, controlling the drying-gas temperature in at least one initial and one subsequent sector of the drier using respective different ones of at least two negative-feedback temperature controllers in dependence upon said control signals.

4. The method defined in claim 1, in response to the measurement of heat-consumption rates in excess of a predetermined value applying a corresponding signal to a transport-speed controller to produce an automatic corrective adjustment in the transport speed of the goods through the drier.

5. The method defined in claim 1, in response to the measurement of heat-consumption rates in excess of a predetermined value generating a warning signal to alert the operator that the transport speed of the drier must be adjusted.

6. The method defined in claim 4, the heat-consumption rate in dependence upon which said signal is applied to a transport-speed controller being the heat-consumption rate in one of said subsequent zones of the drier.

7. The method defined in claim 5, the heat-consumption rate in dependence upon which said warning signal is generated being the heat-consumption rate in one of said subsequent zones of the drier.

8. The method defined in claim 1, the measurement of heat-consumption rate being performed using two thermometers in the respective zone, one thermometer being located to measure the temperature of the drying gas just upstream of its contact with the goods in such zone and the other being located to measure the temperature of the drying gas just downstream of its contact with the goods in such zone.

9. The method defined in claim 1, the drying zones of the multi-zone drier being provided with respective reheating means for reheating the circulated drying gas therein after the drying gas contacts the goods in such zone, the measurement of heat-consumption rate being performed using two thermometers in the respective zone, one thermometer being located to measure the temperature of the drying gas just upstream of its contact with the reheating means and the other thermometer being located to measure the temperature of the drying gas just downstream of its contact with the reheating means.

10. In a continuous-operation multi-zone drier of the type comprised of successive drying zones through which are transported plyboards or analogous goods of varying initial moisture content which present to the drier a varying degree of surface-area loading and provided with means circulating drying gas in each drying zone in the direction transverse to the transport direction of the goods and provided with means for adjusting the drying action occurring in the drying zones by adjusting the drying-gas temperature in the drying zones and by adjusting the transport speed of goods transported through the multi-zone drier, the rate of heat consumption in the initial zones of the drier varying mainly as a function of variations in the degree of surface-area loading presented to the drier by the goods and only secondarily as a function of variations in the initial moisture content of the goods, the rate of heat consumption in the subsequent zones of the drier varying as a function of both variations in the degree of surface-area loading presented to the drier by the goods and also as a function of variations in the initial moisture content of the goods, in combination therewith, means for automatically adjusting the drying action so as to maintain a predetermined moisture content of the goods emerging from the multi-zone drier despite variations in the degree of surface-area loading presented to the drier by the goods and despite variations in the initial moisture content of the goods, including means measuring the rate of heat consumption in at least one of the initial zones of the multi-zone drier to develop a first signal mainly dependent upon the degree of surface-area loading presented to the drier by the goods;

means measuring the rate of heat consumption in at least one of the subsequent zones of the multi-zone drier to develop a second signal dependent upon both the degree of surface-area loading presented by the goods and the initial moisture content of the goods; and means receiving the first and second signals and developing from the first and second signals in combination control signals which automatically control at least one of said temperature adjusting means and said transport-speed adjusting means.

11. The multi-zone drier defined in claim 10, the means developing the first signal and the means developing the second signal each comprising two thermometers of which one is located upstream of the location where the drying gas contacts the goods and the other downstream thereof.

* * * * *